US011319810B1

(12) United States Patent
Tang et al.

(10) Patent No.: US 11,319,810 B1
(45) Date of Patent: May 3, 2022

(54) MONITORING DEVICE FOR DEFORMATION OF LOCKED PATCH CRACK OF ROCK SLOPE AND ARRANGEMENT METHOD

(71) Applicant: CHINA UNIVERSITY OF GEOSCIENCES (WUHAN), Wuhan (CN)

(72) Inventors: Huiming Tang, Wuhan (CN); Junrong Zhang, Wuhan (CN); Changdong Li, Wuhan (CN); Wenping Gong, Wuhan (CN); Yongquan Zhang, Wuhan (CN); Zongxing Zou, Wuhan (CN); Chengyuan Lin, Wuhan (CN)

(73) Assignee: CHINA UNIVERSITY OF GEOSCIENCES (WUHAN), Wuhan (CN)

( * ) Notice: Subject to any disclaimer, the term of this patent is extended or adjusted under 35 U.S.C. 154(b) by 0 days.

(21) Appl. No.: 17/401,337

(22) Filed: Aug. 13, 2021

Related U.S. Application Data

(63) Continuation of application No. PCT/CN2021/107492, filed on Jul. 21, 2021.

(30) Foreign Application Priority Data

Jun. 23, 2021 (CN) ..... 202110700645.6

(51) Int. Cl.
*E21D 11/00* (2006.01)
*E21D 11/10* (2006.01)
*E21F 15/10* (2006.01)

(52) U.S. Cl.
CPC ..... *E21D 11/105* (2013.01); *E21F 15/10* (2013.01)

(58) Field of Classification Search
CPC ..... E21D 11/105; E21D 15/10; E02D 33/00; E02D 17/20; G01V 1/008; G01V 2210/6248
See application file for complete search history.

(56) References Cited

U.S. PATENT DOCUMENTS 4,461,171 A * 7/1984 de la Cruz ..... E21B 49/006 73/152.59
5,737,219 A * 4/1998 Vartanyan ..... G01V 1/008 702/15
9,347,312 B2 * 5/2016 Vincelette ..... E21B 43/2406
9,538,946 B2 1/2017 Rasdal et al.
(Continued)

*Primary Examiner* — Benjamin F Fiorello
(74) *Attorney, Agent, or Firm* — True Shepherd LLC; Andrew C. Cheng

(57) ABSTRACT

An arrangement method for deformation of a locked patch crack of a rock slope, includes: connecting a filling pipeline on a bladder-type monitoring probe to a mortar guiding pipe through an automatic locking and unlocking device, clamping a portion to be clamped on a bladder by a clamping assembly, driving a clamping driving mechanism to move towards an adit by a push driving mechanism, and pushing the bladder into the adit; injecting cement mortar into the bladder through the mortar guiding pipe by utilizing a high-pressure injection machine to expand the bladder until an upper surface and a lower surface of the bladder abut against an upper surface and a lower surface of the adit, and making a monitor on the bladder abut against the upper and lower surfaces of the adit; and arranging a plurality of bladder-type monitoring probes in an array in the adit.

10 Claims, 9 Drawing Sheets

(56) References Cited

U.S. PATENT DOCUMENTS

| | | | | |
|---|---|---|---|---|
| 10,036,823 | B2 * | 7/2018 | Chen | G01V 3/08 |
| 10,918,318 | B2 | 2/2021 | Pryor et al. | |
| 10,925,524 | B2 | 2/2021 | Pryor et al. | |
| 10,976,455 | B2 * | 4/2021 | Liu | G01V 1/181 |
| 2014/0216165 | A1 * | 8/2014 | Hayward | G01L 19/0061 73/753 |
| 2017/0134923 | A1 * | 5/2017 | Kuznetsov | H04W 4/06 |
| 2017/0146678 | A1 * | 5/2017 | Chen | G01V 3/08 |
| 2017/0287308 | A1 * | 10/2017 | Takeda | H04Q 9/02 |
| 2018/0372893 | A1 * | 12/2018 | Liu | G01N 29/223 |
| 2019/0203594 | A1 * | 7/2019 | Jiao | G01V 1/28 |
| 2019/0316462 | A1 * | 10/2019 | Zou | E21B 47/06 |

* cited by examiner

MONITORING DEVICE FOR DEFORMATION OF LOCKED PATCH CRACK OF ROCK SLOPE AND ARRANGEMENT METHOD

CROSS-REFERENCE TO RELATED APPLICATIONS

This application is a continuation of International Patent Application No. PCT/CN2021/107492 with a filing date of Jul. 21, 2021, designating the United States, now pending, and further claims priority to Chinese Patent Application No. 202110700645.6 with a filing date of Jun. 23, 2021. The content of the aforementioned applications, including any intervening amendments thereto, are incorporated herein by reference.

TECHNICAL FIELD

The present disclosure relates to the technical field of geological disaster monitoring, in particular to a monitoring device for deformation of a locked patch crack of a rock slope and an arrangement method.

BACKGROUND

Large-scale rock landslides occur with sudden release of high strain energy, and are prone to cause major casualties and economic losses due to their suddenness and large volumes. Being widely spread, a locked patch rock landslide is mainly characterized by one potential slip surface composed of a front locked patch and a tensile fracture zone at a rear edge. Under the action of unloading, raining or flooding, strain energy of rock mass of the locked patch gradually accumulates until the rock mass is destroyed.

A rock landslide needs to be monitored so as to give early warning to developing disasters, and landslide monitoring has always been a focus of geological disaster research. A common macroscopic sign monitoring method for such a landslide uses crack meters, global positioning system (GPS), D-interferometric synthetic aperture radar (InSAR), etc. for monitoring the macroscopic deformation of the surface of such a landslide, which has become a conventional means to identify potential landslides. However, the above method is useless for landslides with unclear precursory information, such as the locked patch rock landslide. Such a landside is prominently featured with the locked patches and tensile fracture zones, but overlying soil layers and vegetation in the tensile fracture zones at the rear edge often cover these important features, which is not conducive to monitoring layout. Dominative cracks exposed in the locked patch at the front edge are often close to steep rock faces, and therefore are not prone to be covered by the soil layers and vegetations. If the problems of layout in a deep position of a crack surface and wading at the front edge are overcome, it is of great significance to monitor stresses and opening and closing states of these dominative cracks for obtaining of a strain energy accumulation state of rock mass in the locked patch and the overall downward trend of the rock mass and for monitoring and early warning.

SUMMARY

In view of this, in order to solve the above problems, embodiments of the present disclosure provide a monitoring device for deformation of a locked patch crack of a rock slope and an arrangement method.

The embodiment of the present disclosure provides the monitoring device for deformation of a locked patch crack of a rock slope. The monitoring device includes:

a bladder-type monitoring probe including a bladder, a filling pipeline and a monitor, where the bladder is in communication with an outlet of the filling pipeline, a check valve is arranged on the filling pipeline, a portion to be clamped is fixed on the bladder, and the monitor is fixed on an upper surface and/or a lower surface of the bladder; and an arrangement system including a traction mechanism, a high-pressure injection machine and an underwater arrangement device, where the traction mechanism is used for lowering the underwater arrangement device to an underwater position corresponding to an adit; the high-pressure injection machine is connected to the filling pipeline through a mortar guiding pipe, the mortar guiding pipe being in communication with an inlet of the filling pipeline through an automatic locking and unlocking device, and the automatic locking and unlocking device being used for automatically locking and unlocking the filling pipeline and the mortar guiding pipe so as to inject cement mortar into the bladder by utilizing the high-pressure injection machine; and the underwater arrangement device includes a push driving mechanism, a clamping driving mechanism and a clamping assembly, where the clamping assembly is mounted on the clamping driving mechanism, the clamping assembly has a clamping position in which the portion to be clamped is clamped and an unlocking position in which the portion to be clamped is released, the clamping driving mechanism drives the clamping assembly to be switched between the clamping position and the unlocking position, the clamping driving mechanism is mounted on the push driving mechanism, and the push driving mechanism drives the clamping driving mechanism to move towards the adit so as to push the bladder-type monitoring probe into the adit.

Further, the clamping driving mechanism includes a hollowed limiting shell, a rack and a drive motor;

the limiting shell is fixedly connected to the push driving mechanism, the rack extends in a left-right direction and is capable of being movably mounted in the limiting shell in the left-right direction, the drive motor is mounted in the limiting shell, a drive shaft of the drive motor is provided with a gear meshing with the rack, and the drive motor drives the gear to rotate to drive the rack to move in the left-right direction; and the clamping assembly includes two link mechanisms, where the two link mechanisms are symmetrically arranged, a straight line of centers of the two link mechanisms is perpendicular to a left-right direction, and the link mechanism includes a first link and a second link, where a right end of the first link and a left end of the second link are hinged to form a hinged portion, a left end of the first link is hinged to a right end of the rack, a hinge pin is connected between a middle of the second link and the limiting shell, two hinged portions are located on two sides of the rack respectively, right ends of the two second links are connected to clamping portions respectively, and the rack moves in the left-right direction to drive the two clamping portions to move close to or away from each other.

Further, the monitoring device further includes a stopper, where the stopper is fixed in the limiting shell and located on one side, away from the second link, of the first link, and the first link abuts against the stopper when the clamping assembly is located in the unlocking position.

Further, the underwater arrangement device further includes a housing, the housing being provided with a mounting groove with a groove mouth facing rightwards, and the push driving mechanism includes a push hydraulic cylinder and an eight-link mechanism, where the eight-link mechanism is mounted in the mounting groove, the push hydraulic cylinder is fixed on a bottom wall of the mounting groove, a piston rod of the push hydraulic cylinder extends in a left-right direction and is hinged to one end of the eight-link mechanism, and the other end of the eight-link mechanism is connected to the clamping driving mechanism.

Further, the underwater arrangement device further includes a first clamping and fixing device and a second clamping and fixing device;

the first clamping and fixing device includes a first hydraulic cylinder and a first support arm, the second clamping and fixing device includes a second hydraulic cylinder and a second support arm, the first support arm and the second support arm being positioned at an upper side and a lower side of the mounting groove, with right ends protruding out of the mounting groove; and the first hydraulic cylinder is mounted on the housing and connected to the first support arm, the second hydraulic cylinder is mounted on the housing and connected to the second support arm, and the first hydraulic cylinder and the second hydraulic cylinder drive the first support arm and the second support arm respectively to move close to or away from each other in an up-down direction, such that sides, away from each other, of the first support arm and the second support arm abut against an upper surface and a lower surface of the adit.

Further, the automatic locking and unlocking device includes a connection pipe and a locking and unlocking mechanism, the locking and unlocking mechanism including a locking hydraulic cylinder, a wedge-shaped seat, a wedge-shaped tooth and a spring; and one end of the connection pipe is connected to the mortar guiding pipe, and the other end of the connection pipe is used for the filling pipeline to be inserted thereinto, an inner side wall of a middle of the connection pipe is provided with a recessed groove, the locking hydraulic cylinder is fixed in the recessed groove, a piston rod of the locking hydraulic cylinder and the connection pipe extend in the same direction, the wedge-shaped seat is fixedly connected to the piston rod of the locking hydraulic cylinder, the wedge-shaped seat abuts against a side wall of the connection pipe, the wedge-shaped tooth is located on an inner side of the wedge-shaped seat and fixedly connected to the recessed groove through the spring, the spring and the connection pipe extend in the same direction, a tooth opening of the wedge-shaped seat matches a tooth opening of the wedge-shaped tooth, the locking hydraulic cylinder drives the wedge-shaped seat to move towards the spring, and the wedge-shaped tooth is pushed to move inwards under elasticity of the spring, and one side, away from the wedge-shaped seat, of the wedge-shaped tooth is used for abutting against an outer side wall of the filling pipeline to fix the filling pipeline in the connection pipe.

Further, two locking and unlocking mechanisms are arranged, two opposite recessed grooves are arranged on the inner side wall of the middle of the connection pipe, the two locking and unlocking mechanisms are fixed in the recessed grooves respectively and the two wedge-shaped teeth are located on opposite sides of the filling pipeline; and/or, a wedge-shaped groove is provided on a position, opposite the wedge-shaped tooth, of the outer side wall of the filling pipeline, a side wall, close to the spring, of the wedge-shaped groove is vertically arranged, and a side wall, close to the locking hydraulic cylinder, of the wedge-shaped groove is a smooth inclined plane and extends to the outer side wall of the filling pipeline.

Further, the monitoring device further includes sonar, where the sonar is fixed on the housing, made waterproof and used for determining a position of the adit; and/or, a top and a bottom of the housing are fixedly provided with underwater driving devices respectively, and the underwater driving devices are used for driving the underwater arrangement device to move on all sides under the water.

Further, the monitoring device further includes a monitoring system, where the monitoring system includes a solar power supply module, monitoring control equipment and a monitoring pier;

the monitoring pier is poured in an open and stable place beside a rock landslide, the monitoring control equipment and the solar power supply module are fixed on the monitoring pier, the monitoring control equipment is electrically connected to a monitor on the bladder through a monitoring cable to obtain monitoring data of the monitor, and sends the monitoring data to a mobile monitoring terminal or a network through general packet radio service (GPRS) to facilitate monitoring by a monitoring worker at any time, and the solar power supply module is electrically connected to the monitor on the bladder through a monitoring cable, is electrically connected to monitoring control equipment, and continuously supplies power during a monitoring process; and/or, a shaping steel ring is fixed on a periphery of the bladder, and the portion to be clamped is fixed on the shaping steel ring.

The embodiment of the present disclosure further provides an arrangement method. Based on the monitoring device for deformation of a locked patch crack of a rock slope above, the method includes:

S1, determining, based on previous geological survey work, a position of an adit of a rock landslide to be monitored, and anchoring a ship carrying an arrangement system beside water surface of an entrance of the adit;

S2, connecting a filling pipeline on a bladder-type monitoring probe to a mortar guiding pipe through an automatic locking and unlocking device, driving a clamping assembly to be positioned in a clamping position by utilizing a clamping driving mechanism, so as to clamp a portion to be clamped on the bladder, and lowering an underwater arrangement device to a position opposite the adit by utilizing a traction mechanism;

S3, driving the clamping driving mechanism to move towards the adit by utilizing a push driving mechanism, and pushing the bladder into the adit;

S4, injecting cement mortar into the bladder through the mortar guiding pipe by utilizing a high-pressure injection machine to expand the bladder until an upper surface and a lower surface of the bladder abut against an upper surface and a lower surface of the adit respectively, and making a monitor on the bladder abut against the upper surface and the lower surface of the adit;

S5, unlocking the filling pipeline and the mortar guiding pipe by utilizing the automatic locking and unlocking device, driving the clamping assembly to be in an unlocking position by utilizing the clamping driving mechanism, driving the clamping driving mechanism to retract by utilizing the push driving mechanism, and lifting the underwater arrangement device to water surface by utilizing the traction mechanism; and S6, repeating S2-S5 to arrange a plurality of bladder-type monitoring probes in an array in the adit.

A technical solution provided by the embodiment of the present disclosure has the beneficial effects: a locked/unlocked rock landslide is taken as a monitoring object, and an attitude change of the rock landslide is monitored by arranging pressure sensors in an array in the adit below sliding mass, such that deformation data of the sliding mass are indirectly obtained. The method has high sensitivity and may obtain a development condition of the sliding mass from the inside more accurately. The present disclosure provides the whole set of novel bladder-type monitoring probes, the corresponding arrangement system and the monitoring system with consideration of complex environmental factors of underwater sensor arrangement, which may better adapt to the underwater arrangement environment. The sensors related to the present disclosure are all technically mature devices with high reliability and automation degrees. The present disclosure further considers karst water generated by karstification, and initiatively captures the karstification in situ by adding a calcium ion monitoring probe in the bladder-type monitoring probe, so as to better understand an unlocking process of the locked patch.

Figure 1:
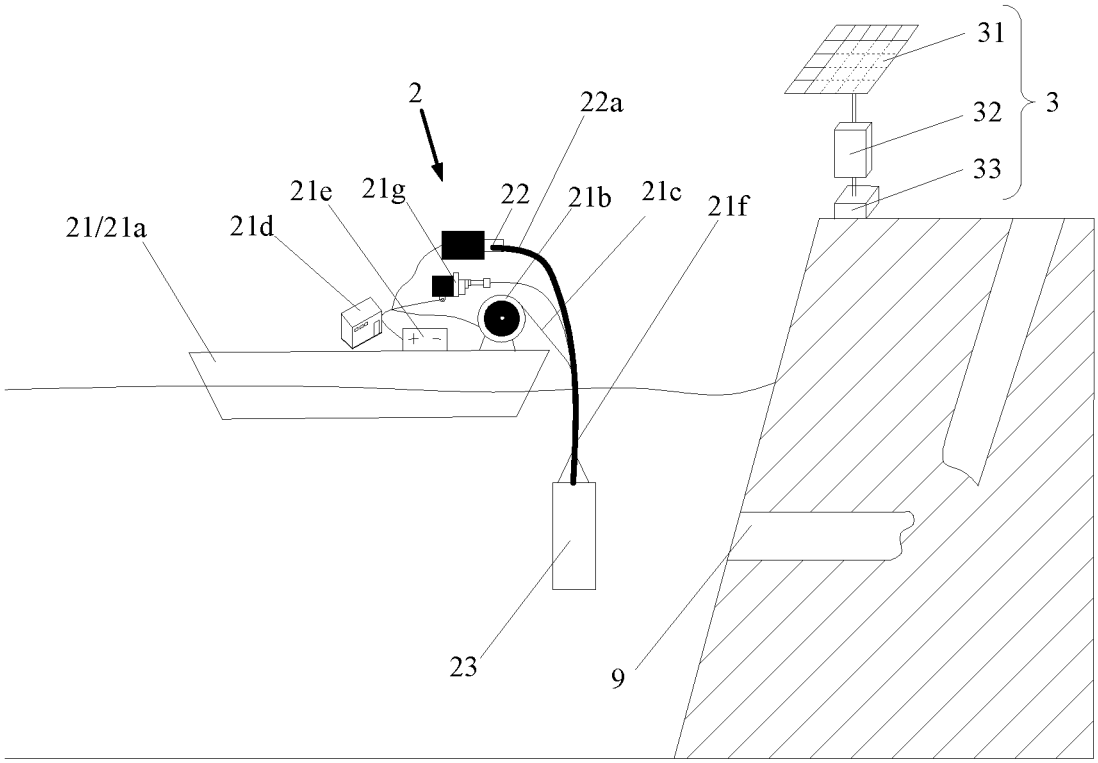
FIG. 1 is a structural schematic diagram of an embodiment of a monitoring device for deformation of a locked patch crack of a rock slope provided by the present disclosure.

In the figures: bladder-type monitoring probe 1, bladder 11, portion to be clamped 11*a*, shaping steel ring 11*b*, filling pipeline 12, check valve 12*a*, sealing ring 12*b*, wedge-shaped groove 12*c*, pressure sensor group 13, calcium ion monitoring probe 14, arrangement system 2, traction mechanism 21, ship 21*a*, winch 21*b*, steel cable 21*c*, control module 21*d*, power supply module 21*e*, integrated cable 21*f*, hydraulic pump 21*g*, high-pressure injection machine 22, mortar guiding pipe 22*a*, underwater arrangement device 23, first clamping and fixing device 24, first hydraulic cylinder 24*a*, first support arm 24*b*, second clamping and fixing device 25, second hydraulic cylinder 25*a*, second support arm 25*b*, monitoring system 3, solar power supply module 31, monitoring control equipment 32, monitoring pier 33, automatic locking and unlocking device 4, connection pipe 41, recessed groove 41*a*, locking hydraulic cylinder 42, wedge-shaped seat 43, wedge-shaped tooth 44, spring 45, housing 5, fixation ring 51, underwater driving device 52, mounting groove 53, mounting recessed groove 54, integrated circuit board 55, sonar 56, push driving mechanism 6, push hydraulic cylinder 61, eight-link mechanism 62, clamping driving mechanism 7, limiting shell 71, rack 72, drive motor 73, link mechanism 8, first link 81, second link 82, hinged portion 83, hinge pin 84, clamping portion 85, cambered groove 85*a*, stopper 86 and adit 9.

DETAILED DESCRIPTION OF THE EMBODIMENTS

In order to make the objectives, technical solutions and advantages of the present disclosure clearer, the implementations of the present disclosure are described in more detail below with reference to the accompanying drawings.

It is defined that a right-left direction refers to a horizontal direction, and an up-down direction refers to a vertical direction.

With reference to FIGS. 1 to 9, the embodiment of the present disclosure provides a monitoring device for deformation of a locked patch crack of a rock slope. The monitoring device includes a bladder-type monitoring probe 1, an arrangement system 2 and a monitoring system 3.

Figure 2:
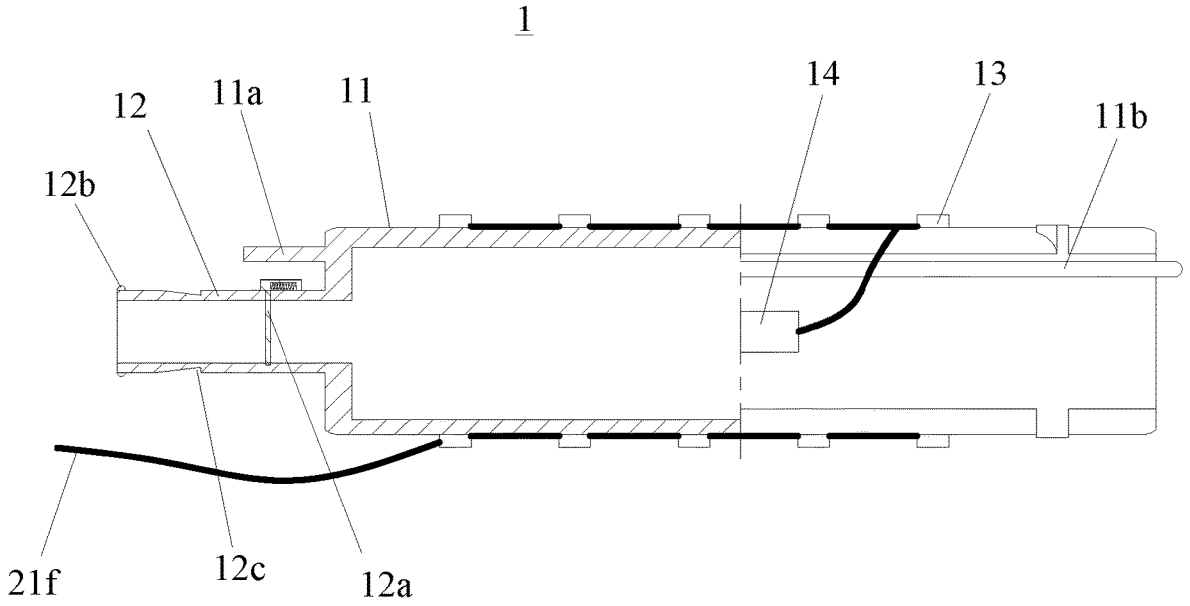
FIG. 2 is a structural schematic diagram of a bladder-type monitoring probe in FIG. 1.
Figure 3:
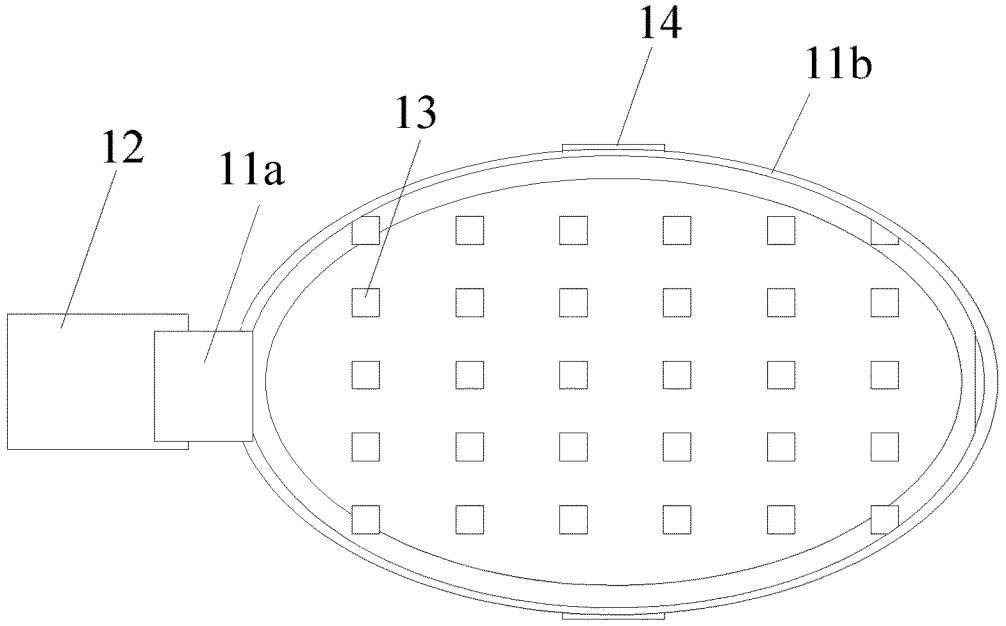
FIG. 3 is a top view of the bladder-type monitoring probe in FIG. 2.

With reference to FIG. 2 and FIG. 3, the bladder-type monitoring probe 1 includes a bladder 11, a filling pipeline 12 and a monitor, where the bladder 11 is in communication with an outlet of the filling pipeline 12, a check valve 12*a* is arranged on the filling pipeline 12, cement mortar may be injected into the bladder 11 through the filling pipeline 12, and the injected cement mortar should be Portland cement with high strength and low dry shrinkage. The check valve 12*a* prevents the injected substance from flowing back or escaping under the pressure of the bladder 11. A portion to be clamped 11*a* is fixed on the bladder 11, and the monitor is fixed on the bladder 11.

A shaping steel ring 11*b* is fixed on a periphery of the bladder 11, and the portion to be clamped 11*a* is fixed on the shaping steel ring 11*b*. Specifically, the bladder 11 is in a shape of an elliptical soap box, and the shaping steel ring 11*b* is arranged on the bladder 11, such that an upper surface and a lower surface of the bladder 11 may be kept horizontal in the process of pushing the bladder 11 into an adit 9, thereby avoiding the problems of scratching, twisting of the upper surface and the lower surface caused by hanging of the bladder 11. A material of the bladder 11 may be selected according to a specific monitoring environment and the principle that an upper surface and a lower surface of the bladder 11 should be attached to a side wall of the adit 9 after the bladder 11 is filled. For a monitoring object whose adit 9 has flat upper surface and lower surface, thermoplastic polyurethane (TPU), polyethylene vinyl acetate (PEVA) and other materials with strong plasticity should be used, and for a monitoring object whose adit 9 has an uneven upper surface and lower surface, materials such as rubber with desirable flexibility and elasticity should be selected, so as to fill gaps in a filling process and better monitor the object.

In this embodiment, the monitor includes a pressure sensor group 13 and a calcium ion monitoring probe 14, where the pressure sensor group 13 is fixed on an upper surface and/or a lower surface of the bladder 11, and the pressure sensor group 13 is arranged in an array, and connected to each other through a flat cable, fixed on the upper surface and the lower surface of the bladder 11 through gluing or other processes and subjected to waterproof treatment. The flat cable should be sufficient for later use when a distance between the pressure sensors is increased in a filling process of the bladder 11. The calcium ion monitoring probe 14 is fixed on a side of the shaping steel ring 11*b*, and both the pressure sensor and the calcium ion monitoring probe 14 are electrically connected to the monitoring cable, thereby realizing monitoring data transmission, control and power supply.

With reference to FIG. 1, the monitoring system 3 includes a solar power supply module 31, monitoring control equipment 32 and a monitoring pier 33. The monitoring pier 33 is poured in an open and stable place beside a rock landslide, the monitoring control equipment 32 and the solar power supply module 31 are fixed on the monitoring pier 33, the monitoring control equipment 32 is electrically connected to a monitor on the bladder 11 through a monitoring cable to obtain monitoring data of the monitor, and sends the monitoring data to a mobile monitoring terminal or a network through general packet radio service (GPRS) to facilitate monitoring at any time, and the solar power supply module 31 is electrically connected to the monitor on the bladder 11 through a monitoring cable, is electrically connected to monitoring control equipment 32, and continuously supplies power during a monitoring process.

The arrangement system 2 includes a traction mechanism 21, a high-pressure injection machine 22 and an underwater arrangement device 23. The traction mechanism 21 is used for lowering the underwater arrangement device 23 to an underwater position corresponding to the adit 9.

The traction mechanism 21 includes a ship 21*a*, a winch 21*b*, a steel cable 21*c*, a control module 21*d*, a power supply module 21*e* and an integrated cable 21*f* The integrated cable 21*f* includes a hydraulic oil pipe, a control and power supply cable, etc. When arranged, the ship 21*a* is anchored on water surface beside the monitored rock landslide, and the winch 21*b*, the control module 21*d* and the power supply module 21*e* are all fixed on the ship 21*a*. The winch 21*b* is electrically connected to the control module 21*d* and connected to the underwater arrangement device 23 through the steel cable 21*c*. The control module 21*d* controls the underwater arrangement device 23 to be lowered and lifted by controlling the winch 21*b* to rotate forward and reversely respectively. The power supply module 21*e* is electrically connected to each electric device to provide power required in an arrangement stage.

The high-pressure injection machine 22 is fixed on the ship 21*a* with cement mortar prepared. The high-pressure injection machine 22 is connected to the filling pipeline 12 through a mortar guiding pipe 22*a*, the mortar guiding pipe 22*a* is in communication with an inlet of the filling pipeline 12 through an automatic locking and unlocking device 4, and the automatic locking and unlocking device 4 is used for automatically locking and unlocking the filling pipeline 12 and the mortar guiding pipe 22*a*, so as to inject cement mortar into the bladder 11 by utilizing the high-pressure injection machine 22.

Figure 4:
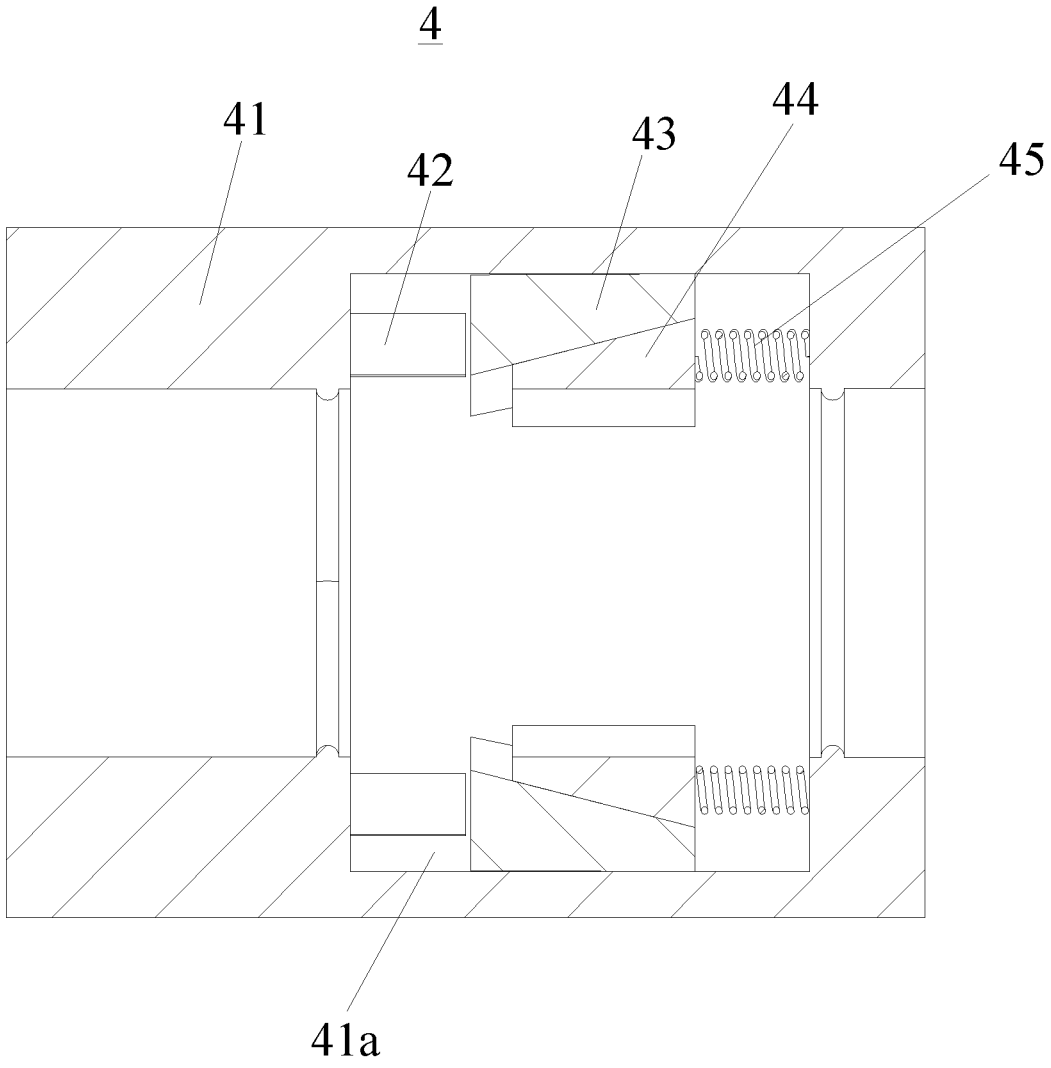
FIG. 4 is a structural schematic diagram of an automatic locking and unlocking device in FIG. 1.
Figure 5:
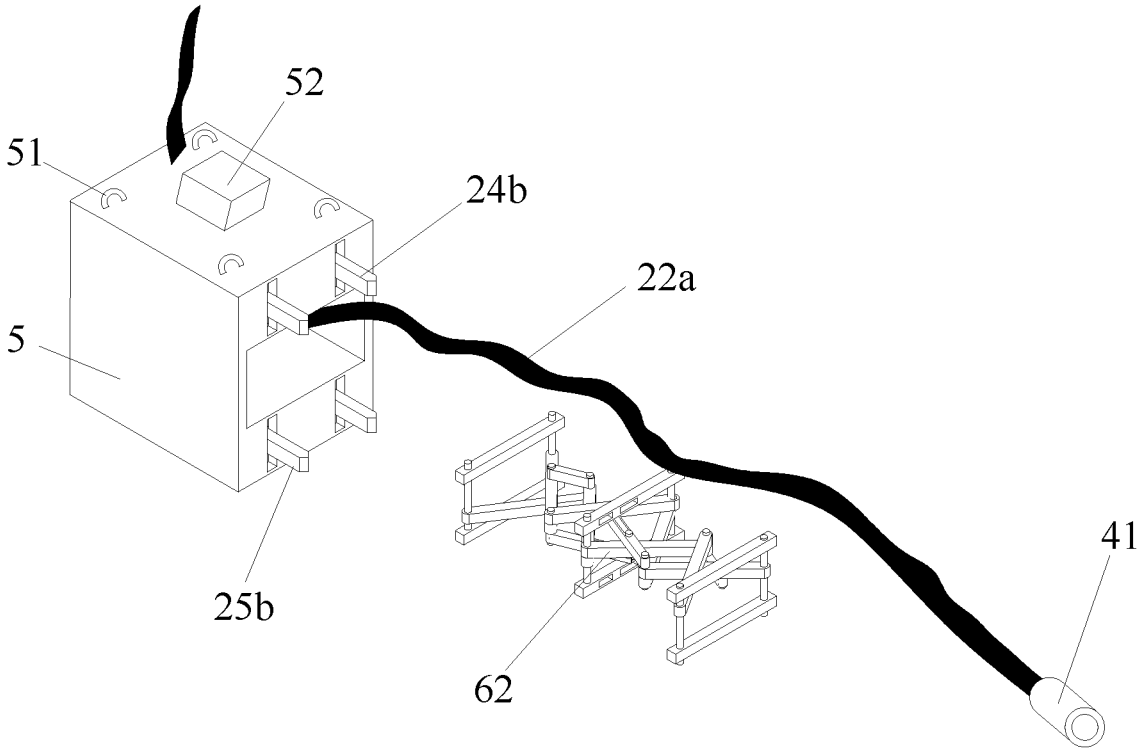
FIG. 5 is a partial structural schematic diagram of an underwater arrangement device in FIG. 1.

Specifically, with reference to FIG. 4 and FIG. 5, the automatic locking and unlocking device 4 includes a connection pipe 41 and a locking and unlocking mechanism, the locking and unlocking mechanism including a locking hydraulic cylinder 42, a wedge-shaped seat 43, a wedge-shaped tooth 44 and a spring 45. One end of the connection pipe 41 is connected to the mortar guiding pipe 22*a*, and the other end of the connection pipe is used for the filling pipeline 12 to be inserted thereinto, an inner side wall of a middle of the connection pipe 41 is provided with a recessed groove 41*a*, the locking hydraulic cylinder 42 is fixed in the recessed groove 41*a*, a piston rod of the locking hydraulic cylinder 42 and the connection pipe 41 extend in the same direction, the wedge-shaped seat 43 is fixedly connected to the piston rod of the locking hydraulic cylinder 42, the wedge-shaped seat 43 abuts against a side wall of the connection pipe 41, the wedge-shaped tooth 44 is located on an inner side of the wedge-shaped seat 43 and fixedly connected to the recessed groove 41*a* through the spring 45, the spring 45 and the connection pipe 41 extend in the same direction, a tooth opening of the wedge-shaped seat 43 matches a tooth opening of the wedge-shaped tooth 44, the locking hydraulic cylinder 42 drives the wedge-shaped seat 43 to move towards the spring 45, the wedge-shaped tooth 44 is pushed to move inwards under elasticity of the spring 45, and one side, away from the wedge-shaped seat 43, of the wedge-shaped tooth 44 is used for abutting against an outer side wall of the filling pipeline 12 to fix the filling pipeline 12 in the connection pipe 41.

The filling pipeline 12 is inserted into the connection pipe 41, the locking hydraulic cylinder 42 is started, and the piston rod of the locking hydraulic cylinder 42 pushes the wedge-shaped seat 43 to move rightwards. Since the wedge-shaped tooth 44 is stopped by the spring 45, the wedge-shaped seat 43 pushes the wedge-shaped tooth 44 to move inwards during rightward movement, so as to make the wedge-shaped tooth 44 abut against the filling pipeline 12. In this embodiment, two automatic locking and unlocking mechanisms are arranged, two opposite recessed grooves 41*a* are arranged on the inner side wall of the middle of the connection pipe 41, the two automatic locking and unlocking devices 4 are fixed in the recessed grooves 41*a* respectively, the two wedge-shaped teeth 44 are located on opposite sides of the filling pipeline 12, and the two wedge-shaped teeth 44 are utilized to clamp the filling pipeline 12, so as to lock the filling pipeline 12. One end, inserted into the connection pipe 41, of the filling pipeline 12 is provided with a sealing ring 12*b* to ensure tightness between the connection pipe 41 and the filling pipeline 12. The locking hydraulic cylinder 42 is connected to a hydraulic pump 21*g* through a hydraulic pipeline, and the hydraulic pump 21*g* is fixed on the ship 21*a* to provide hydraulic power for the locking hydraulic cylinder 42.

A wedge-shaped groove 12*c* is provided on a position, opposite the wedge-shaped tooth 44, of the outer side wall of the filling pipeline 12, a side wall, close to the spring 45, of the wedge-shaped groove 12*c* is vertically arranged, and a side wall, close to the locking hydraulic cylinder 42, of the wedge-shaped groove 12*c* is a smooth inclined plane and extends to the outer side wall of the filling pipeline 12. Since the wedge-shaped tooth 44 is connected to the spring 45, when the wedge-shaped tooth 44 is pushed inwards, the wedge-shaped tooth 44 slides into the wedge-shaped groove 12*c* along the inclined plane. When the locking hydraulic cylinder 42 applies pushing force to the wedge-shaped seat 43, the wedge-shaped tooth 44 are pushed towards the spring 45 while the wedge-shaped tooth 44 are pushed inwards, such that the wedge-shaped tooth 44 abuts against the vertical side wall of the wedge-shaped groove 12*c*, and then horizontal pressing force is exerted on the bladder 11, such that pressure sensors on the upper surface and the lower surface of the bladder 11 abut against the upper surface and the lower surface of the adit 9.

With reference to FIGS. 5 to 9, the underwater arrangement device 23 includes a housing 5, a push driving mechanism 6, a clamping driving mechanism 7 and a clamping assembly.

Four fixation rings 51 are welded at four corners of a top of the housing 5, and are used for connecting steel cables 21*c* in series to facilitate lowering of the underwater arrangement device 23. Sonar 56 is fixed on the housing 5, made waterproof and used for determining a position of the adit 9. Underwater driving devices 52 are fixed at the top and a bottom of the housing 5 respectively, and are fixed at centers of the top and the bottom of the housing 5 respectively. The underwater driving devices 52 are used for driving the underwater arrangement device 23 to move on all sides. The underwater driving device 52 may be an electric motor, etc. in the prior art, which is not described in detail herein.

The housing 5 is provided with a mounting groove 53 with a groove mouth facing rightwards, the push driving mechanism 6 is mounted in the mounting groove 53, the clamping assembly is mounted on the clamping driving mechanism 7, the clamping assembly has a clamping position in which the portion to be clamped 11*a* is clamped and an unlocking position in which the portion to be clamped 11*a* is released, and the clamping driving mechanism 7 drives the clamping assembly to be switched between the clamping position and the unlocking position. The clamping driving mechanism 7 is mounted on the push driving mechanism 6, and the push driving mechanism 6 drives the clamping driving mechanism 7 to move towards the adit 9 so as to push the bladder-type monitoring probe 1 into the adit 9.

The push driving mechanism 6 includes a push hydraulic cylinder 61 and an eight-link mechanism 62. The eight-link mechanism 62 is mounted in the mounting groove 53, the push hydraulic cylinder 61 is fixed on a bottom wall of the mounting groove 53, a piston rod of the push hydraulic cylinder 61 extends in a left-right direction and is hinged to one end of the eight-link mechanism 62, and the other end of the eight-link mechanism 62 is connected to the clamping driving mechanism 7. The push hydraulic cylinder 61 is connected to the hydraulic pump 21*g* through a hydraulic pipeline, and the piston rod of the push hydraulic cylinder 61 pushes the eight-link mechanism 62, thereby stably driving the clamping driving mechanism 7 to move in a left-right direction. The eight-link mechanism 62 belongs to the prior art, and is not described in detail herein. A plurality of eight-link mechanisms 62 may be arranged and connected in series in turn, and the number of eight-link mechanisms 62 connected in series depends on a specific arrangement depth required in the adit 9.

Specifically, the clamping driving mechanism 7 includes a hollowed limiting shell 71, a rack 72 and a drive motor 73. The limiting shell 71 is fixedly connected to the push driving mechanism 6, the rack 72 extends in a left-right direction and may be movably mounted in the limiting shell 71 in the left-right direction, a side wall, opposite the rack 72, of a left end of the limiting shell 71 may be provided with a recession hole allowing the rack 72 to pass therethrough, the drive motor 73 is mounted in the limiting shell 71, a drive shaft of the drive motor 73 is provided with a gear meshing with the rack 72, and the drive motor 73 drives the gear to rotate to drive the rack 72 to move in the left-right direction.

The clamping assembly includes two link mechanisms 8. The two link mechanisms 8 are symmetrically arranged, a straight line of centers of the two link mechanisms 8 is perpendicular to a left-right direction, and in this embodiment, the two link mechanisms 8 are symmetrically arranged in an up-down direction. The link mechanism 8 includes a first link 81 and a second link 82. A right end of the first link 81 and a left end of the second link 82 are hinged through a hinge pin to form a hinged portion 83, a left end of the first link 81 is hinged to a right end of the rack 72 through a hinge pin, a hinge pin 84 is connected between a middle of the second link 82 and the limiting shell 71, two hinged portions 83 are located on two sides of the rack 72 respectively (on an upper side and a lower side in this embodiment), right ends of the two second links 82 are connected to clamping portions 85 respectively, and the rack 72 moves in the left-right direction to drive the two clamping portions 85 to move close to or away from each other (to move close to or away from each other in an up-down direction in this embodiment).

The two link mechanisms 8 may also be located at a front side and a rear side of the rack 72. As long as a direction of a connection line of the centers of the two link mechanisms 8 is perpendicular to the left-right direction, the drive motor 73 drives the gear to rotate. Since the gear meshes with the rack 72, the rack 72 is driven to move rightwards, and the first links 81 rotates away from each other, so as to make the two hinged portions 83 move away from each other slowly. Since the middle of the second link 82 is connected to the limiting shell 71 through the hinge pin 84, the two clamping portions 85 approach each other slowly, the portion to be clamped 11*a* on the bladder 11 is placed between the two clamping portions 85, such that the portion to be clamped 11*a* may be clamped by utilizing the two clamping portions 85. In a reverse direction, the drive motor 73 drives the gear to rotate to drive the rack 72 to move leftwards, and the first links 81 rotates close to each other, such that the two hinged portions 83 approach each other slowly. Since the middle of the second link 82 is connected to the limiting shell 71 through the hinge pin 84, the two clamping portions 85 move away from each other slowly.

In order to enhance clamping stability of the portion to be clamped 11*a* through the two clamping portions 85, opposite side walls of the clamping portions 85 are provided with cambered grooves 85*a* (see FIG. 8), and the portion to be clamped 11 a is located in the cambered groove 85*a*.

A stopper 86 is fixed in the limiting shell 71, the stopper 86 is located on one side, away from the second link 82, of the first link 81, the first link 81 abuts against the stopper 86 when the clamping assembly is located in the unlocking position, so as to limit a maximum distance between the two clamping portions 85, and prevent the gear and rack 72 from being separated due to excessive displacement of the rack 72.

Figure 6:
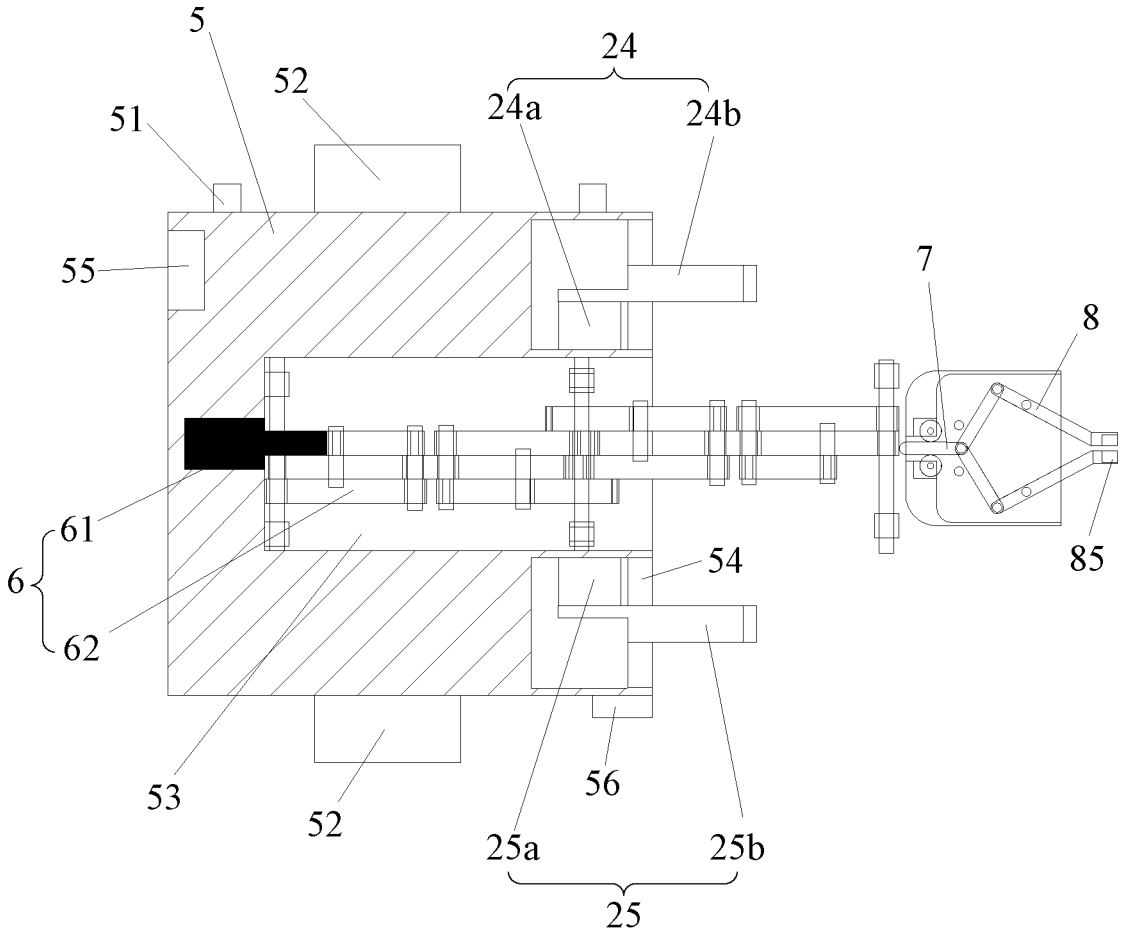
FIG. 6 is a sectional schematic diagram of the underwater arrangement device in FIG. 1
Figure 7:
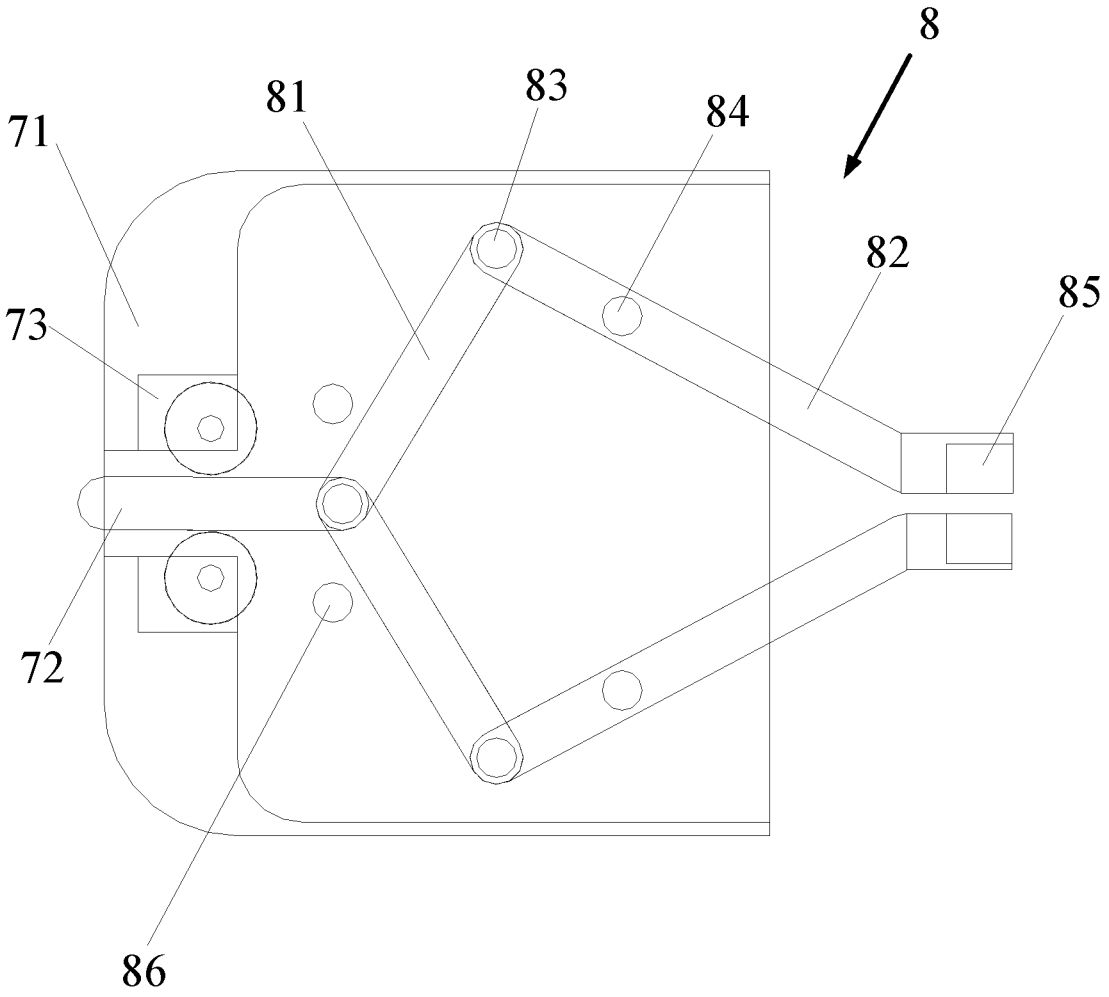
FIG. 7 is a structural schematic diagram of a clamping driving mechanism and a link mechanism in FIG. 6.
Figure 8:
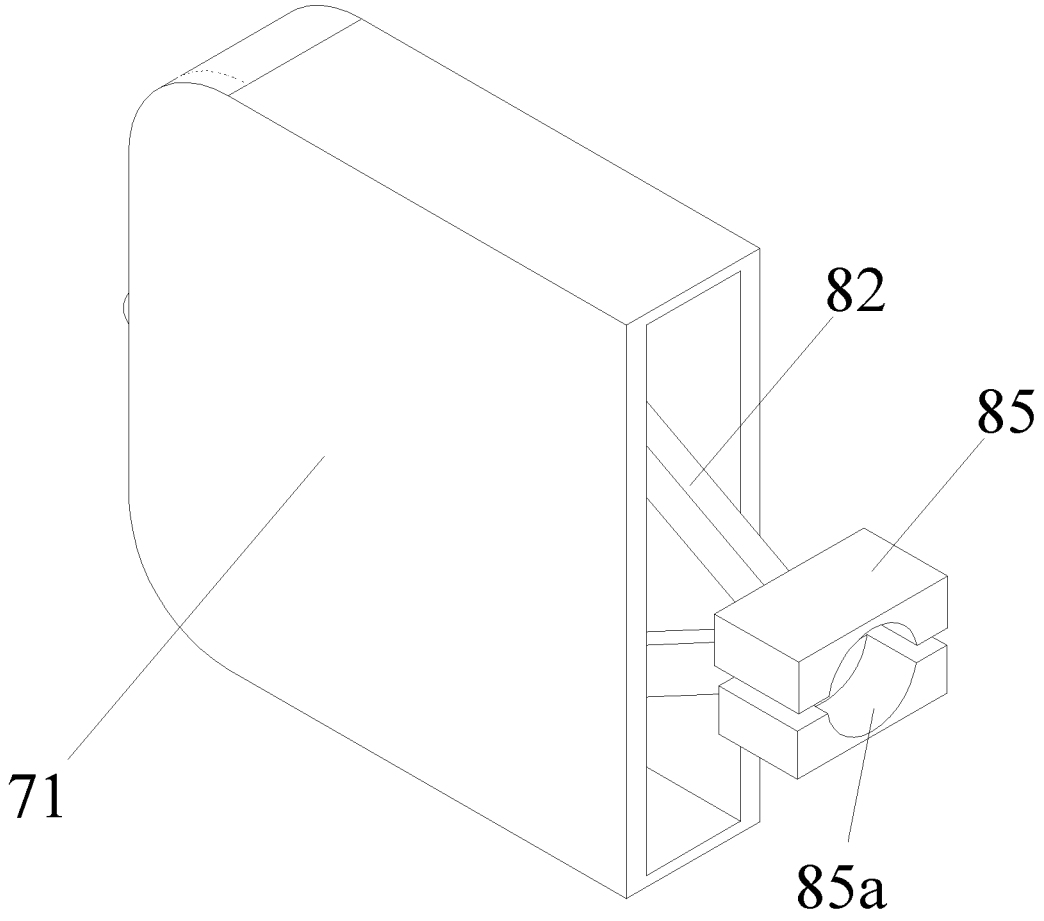
FIG. 8 is a solid diagram of the clamping driving mechanism and a link in FIG. 7.
Figure 9:
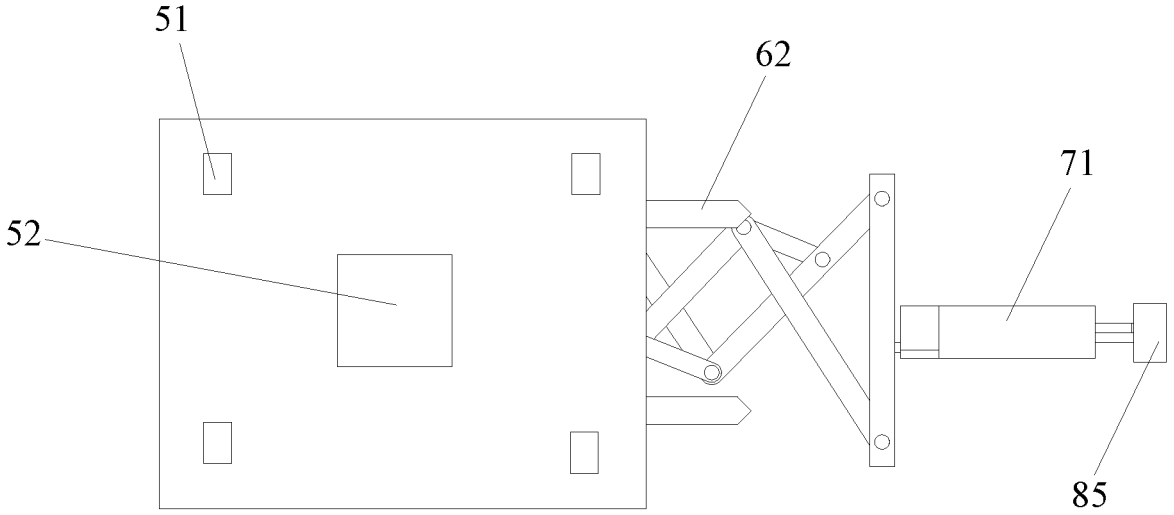
FIG. 9 is a top view of the underwater arrangement device in FIG. 1.

With reference to FIG. 6, the underwater arrangement device 23 further includes a first clamping and fixing device 24 and a second clamping and fixing device 25, the first clamping and fixing device 24 includes a first hydraulic cylinder 24*a* and a first support arm 24*b*, the second clamping and fixing device 25 includes a second hydraulic cylinder 25*a* and a second support arm 25*b*, the first support arm 24*b* and the second support arm 25*b* being positioned at an upper side and a lower side of the mounting groove 53, with right ends protruding out of the mounting groove 53. The first hydraulic cylinder 24*a* is mounted on the housing 5 and connected to the first support arm 24*b*, the second hydraulic cylinder 25*a* is mounted on the housing 5 and connected to the second support arm 25*b*, and the first hydraulic cylinder 24*a* and the second hydraulic cylinder 25*a* drive the first support arm 24*b* and the second support arm 25*b* respectively to move close to or away from each other in an up-down direction, such that sides, away from each other, of the first support arm 24*b* and the second support arm 25*b* abut against an upper surface and a lower surface of the adit 9. The first hydraulic cylinder 24*a* and the second hydraulic cylinder 25*a* are connected to the hydraulic pump 21*g* through hydraulic pipes.

In order to facilitate mounting of the first clamping and fixing device 24 and the second clamping and fixing device 25, two opposite side walls of the mounting groove 53 are provided with mounting recessed grooves 54 with groove mouths facing rightwards, and the first clamping and fixing device 24 and the second clamping and fixing device 25 are mounted in the mounting recessed grooves 54 respectively. In this embodiment, the two mounting recessed grooves 54 are located on an upper side and a lower side of the mounting groove 53. A piston rod of the first hydraulic cylinder 24*a* performs upward jacking to drive the first support arm 24*b* to move upwards, and a piston rod of the second hydraulic cylinder 25*a* performs downward jacking to drive the second support arm 25*b* to move downwards. The first support arm 24*b* and the second support arm match each other to clamp the upper surface and the lower surface of the adit 9, thus fixing the underwater arrangement device 23 underwater.

The housing 5 is internally provided with an integrated circuit board 55 fixedly, the integrated circuit board 55 may be a single chip microcomputer, and the integrated circuit board 55 is connected to the control module 21*d* through an integrated cable 21*f*, and is electrically connected to various devices inside the underwater arrangement device 23, thereby controlling operation of each component.

Figure 10:
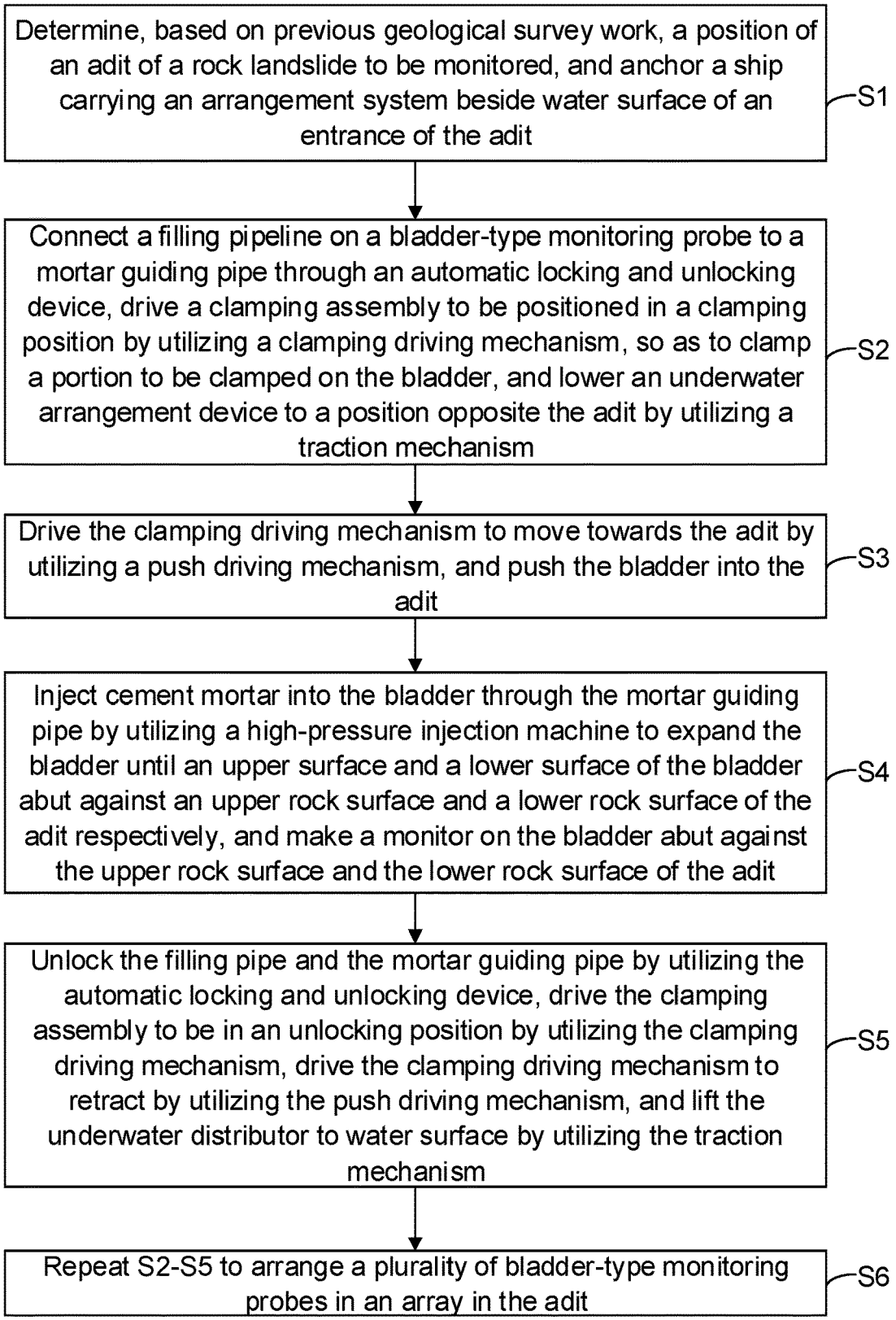
FIG. 10 is a schematic flowchart of an embodiment of an arrangement method provided by the present disclosure.

With reference to FIG. 10, based on the monitoring device for deformation of a locked patch crack of a rock slope above, the embodiment of the present disclosure further includes an arrangement method. The method includes:

S1 based on previous geological survey work, a position of an adit 9 of a rock landslide to be monitored is determined, and a ship 21*a* carrying an arrangement system 2 is anchored beside water surface of an entrance of the adit 9.

S2 a filling pipeline 12 on a bladder-type monitoring probe 1 is connected to a mortar guiding pipe 22*a* through an automatic locking and unlocking device 4, a clamping assembly is driven to be positioned in a clamping position by utilizing a clamping driving mechanism 7, so as to clamp a portion to be clamped 11*a* on the bladder 11, and an underwater arrangement device 23 is lowered to a position opposite the adit 9 by utilizing a traction mechanism 21. Specifically, the underwater arrangement device 23 is controlled to be lowered by the control module 21*d*, and the position of the entrance of the adit 9 is identified on the basis of the sonar 56.

S3 the clamping driving mechanism 7 is driven to move towards the adit 9 by utilizing a push driving mechanism 6, and the bladder 11 is pushed into the adit 9. Specifically, the integrated circuit board 55 is utilized to control the underwater driving device 52 to work, and control the underwater arrangement device 23 to move to the position of the opening, such that an end of the first support arm 24*b* and an end of the second support arm 25*b* are located in the adit 9. The first hydraulic cylinder 24*a* drives the first support arm 24*b* to perform upward jacking, and the second hydraulic cylinder 25*a* drives the second support arm 25*b* to perform downward jacking. The first support arm 24*b* and the second support arm 25*b* match each other to clamp the upper surface and the lower surface of the position of the entrance of the adit 9, thus fixing the underwater arrangement device 23 underwater. The integrated circuit board 55 is utilized to control the push hydraulic cylinder 61 to work, such that the eight-link mechanism 62 is extended to send the bladder 11 into the adit 9.

S4 cement mortar is injected into the bladder 11 through the mortar guiding pipe 22*a* by utilizing a high-pressure injection machine 22 to expand the bladder 11 until an upper surface and a lower surface of the bladder 11 abut against the upper surface and the lower surface of the adit 9 respectively, and a monitor on the bladder 11 is made to abut against the upper surface and the lower surface of the adit 9.

S5 the filling pipeline 12 and the mortar guiding pipe 22*a* are unlocked by utilizing the automatic locking and unlocking device 4, the clamping assembly is driven to be in an unlocking position by utilizing the clamping driving mechanism 7, the clamping driving mechanism 7 is driven to retract by utilizing the push driving mechanism 6, and the underwater arrangement device 23 is lifted to water surface by utilizing the traction mechanism 21. Specifically, the push hydraulic cylinder 61 is controlled to drive the eight-link mechanism 62 to retract and drive the clamping driving mechanism 7 to return into the underwater arrangement device 23. The first hydraulic cylinder 24*a* and the second hydraulic cylinder 25*a* drive the first support arm 24*b* and the second support arm 25*b* respectively to move close to each other to release the hole entrance. The underwater driving device 52 drives the underwater arrangement device 23 to move towards the ship 21*a*, and the underwater arrangement device 23 is lifted to the water surface through the traction mechanism 21.

S6 S2-S5 are repeated, and a plurality of bladder-type monitoring probes 1 are arranged in an array in the adit 9, at least 9 bladder-type monitoring probes 1 are arranged, and the monitor is connected to a monitoring system 3 through a monitoring cable. After cement mortar in the bladder-type monitoring probe 1 solidifies and hardens, readings of a pressure sensor group 13 are all reset to zero. Then, by regularly monitoring data change of a pressure sensor group 13, attitude change of sliding mass of a rock landslide may be sensed, and a deformation trend and law may be obtained indirectly. The plurality of bladder-type monitoring probes 1 arranged in an array in the adit 9 should not be on the same straight line, and at least three bladder-type monitoring probes 1 should be arranged, such that a deformation trend representing the whole ground may be obtained.

According to the technical solution provided in the present disclosure, a locked/unlocked rock landslide is taken as a monitored object, and the attitude change of the rock landslide is monitored by arranging the pressure sensors in an array in the adit 9 below sliding mass, such that deformation data of the sliding mass are indirectly obtained. The method has high sensitivity and may obtain a development condition of the sliding mass from the inside more accurately. The present disclosure provides the whole set of novel bladder-type monitoring probes 1, the corresponding arrangement system 2 and the monitoring system 3 with consideration of complex environmental factors of underwater sensor arrangement, which may better adapt to the underwater arrangement environment. The sensors related to the present disclosure are all technically mature devices with high reliability and automation degrees. The present disclosure further considers karst water generated by karstification, and initiatively captures the karstification in situ by adding the calcium ion monitoring probe 14 in the bladder-type monitoring probe 1, so as to better understand an unlocking process of the locked patch.

Herein, the involved terms front, rear, upper, lower, etc., are defined in terms of the positions of parts and between the parts in the drawings, just for clarity and convenience of expressing the technical solution. It should be understood that the use of such parties should not limit the scope of protection of the claimed application.

The above embodiments and the features of the embodiments herein may be combined with each other without conflict.

The above embodiment is merely a preferred embodiment of the present disclosure but not intended to limit the present disclosure, and any modifications, equivalent replacements, improvements, etc. made within the spirit and principles of the present disclosure shall fall within the scope of protection of the present disclosure.

What is claimed is:

1. A monitoring device for deformation of a locked patch crack of a rock slope, comprising:

a bladder-type monitoring probe comprising a bladder, a filling pipeline and a monitor, wherein the bladder is in communication with an outlet of the filling pipeline, a check valve is arranged on the filling pipeline, a portion to be clamped is fixed on the bladder, and the monitor is fixed on an upper surface and/or a lower surface of the bladder; and an arrangement system comprising a traction mechanism, a high-pressure injection machine and an underwater arrangement device, wherein the traction mechanism is used for lowering the underwater arrangement device to an underwater position corresponding to an adit; the high-pressure injection machine is connected to the filling pipeline through a mortar guiding pipe, the mortar guiding pipe being in communication with an inlet of the filling pipeline through an automatic locking and unlocking device, and the automatic locking and unlocking device being used for automatically locking and unlocking the filling pipeline and the mortar guiding pipe so as to inject cement mortar into the bladder by utilizing the high-pressure injection machine; and the underwater arrangement device comprises a push driving mechanism, a clamping driving mechanism and a clamping assembly, wherein the clamping assembly is mounted on the clamping driving mechanism, the clamping assembly has a clamping position in which the portion to be clamped is clamped and an unlocking position in which the portion to be clamped is released, the clamping driving mechanism drives the clamping assembly to be switched between the clamping position and the unlocking position, the clamping driving mechanism is mounted on the push driving mechanism, and the push driving mechanism drives the clamping driving mechanism to move towards the adit so as to push the bladder-type monitoring probe into the adit.

2. The monitoring device according to claim 1, wherein the clamping driving mechanism comprises a hollowed limiting shell, a rack and a drive motor;

the limiting shell is fixedly connected to the push driving mechanism, the rack extends in a left-right direction and is capable of being movably mounted in the limiting shell in the left-right direction, the drive motor is mounted in the limiting shell, a drive shaft of the drive motor is provided with a gear meshing with the rack, and the drive motor drives the gear to rotate to drive the rack to move in the left-right direction; and the clamping assembly comprises two link mechanisms, wherein the two link mechanisms are symmetrically arranged, a straight line of centers of the two link mechanisms is perpendicular to the left-right direction, and the link mechanism comprises a first link and a second link, wherein a right end of the first link and a left end of the second link are hinged to form a hinged portion, a left end of the first link is hinged to a right end of the rack, a hinge pin is connected between a middle of the second link and the limiting shell, two hinged portions are located on two sides of the rack respectively, right ends of the two second links are connected to clamping portions respectively, and the rack moves in the left-right direction to drive the two clamping portions to move close to or away from each other.

3. The monitoring device according to claim 2, further comprising a stopper, wherein the stopper is fixed in the limiting shell and located on one side, away from the second link, of the first link, and the first link abuts against the stopper when the clamping assembly is located in the unlocking position.

4. The monitoring device according to claim 1, wherein the underwater arrangement device further comprises a housing, the housing being provided with a mounting groove with a groove mouth facing rightwards, and the push driving mechanism comprises a push hydraulic cylinder and an eight-link mechanism, the eight-link mechanism being mounted in the mounting groove, the push hydraulic cylinder being fixed on a bottom wall of the mounting groove, a piston rod of the push hydraulic cylinder extending in a left-right direction and being hinged to one end of the eight-link mechanism, and the other end of the eight-link mechanism being connected to the clamping driving mechanism.

5. The monitoring device according to claim 4, wherein the underwater arrangement device further comprises a first clamping and fixing device and a second clamping and fixing device;

the first clamping and fixing device comprises a first hydraulic cylinder and a first support arm, and the second clamping and fixing device comprises a second hydraulic cylinder and a second support arm, the first support arm and the second support arm being positioned at an upper side and a lower side of the mounting groove, with right ends protruding out of the mounting groove; and the first hydraulic cylinder is mounted on the housing and connected to the first support arm, the second hydraulic cylinder is mounted on the housing and connected to the second support arm, and the first hydraulic cylinder and the second hydraulic cylinder drive the first support arm and the second support arm respectively to move close to or away from each other in an up-down direction, such that sides, away from each other, of the first support arm and the second support arm abut against an upper surface and a lower surface of the adit.

6. The monitoring device according to claim 4, further comprising sonar, wherein the sonar is fixed on the housing, made waterproof and used for determining a position of the adit; and/or, a top and a bottom of the housing are fixedly provided with underwater driving devices respectively, and the underwater driving devices are used for driving the underwater arrangement device to move on all sides under the water.

7. The monitoring device according to claim 1, wherein the automatic locking and unlocking device comprises a connection pipe and a locking and unlocking mechanism, the locking and unlocking mechanism comprising a locking hydraulic cylinder, a wedge-shaped seat, a wedge-shaped tooth and a spring; and one end of the connection pipe is connected to the mortar guiding pipe, and the other end of the connection pipe is used for the filling pipeline to be inserted thereinto, an inner side wall of a middle of the connection pipe is provided with a recessed groove, the locking hydraulic cylinder is fixed in the recessed groove, a piston rod of the locking hydraulic cylinder and the connection pipe extend in the same direction, the wedge-shaped seat is fixedly connected to the piston rod of the locking hydraulic cylinder, the wedge-shaped seat abuts against a side wall of the connection pipe, the wedge-shaped tooth is located on an inner side of the wedge-shaped seat and fixedly connected to the recessed groove through the spring, the spring and the connection pipe extend in the same direction, a tooth opening of the wedge-shaped seat matches a tooth opening of the wedge-shaped tooth, the locking hydraulic cylinder drives the wedge-shaped seat to move towards the spring, and the wedge-shaped tooth is pushed to move inwards under elasticity of the spring, and one side, away from the wedge-shaped seat, of the wedge-shaped tooth is used for abutting against an outer side wall of the filling pipeline to fix the filling pipeline in the connection pipe.

8. The monitoring device according to claim 7, wherein two locking and unlocking mechanisms are arranged, two opposite recessed grooves are arranged on the inner side wall of the middle of the connection pipe, the two locking and unlocking mechanisms are fixed in the recessed grooves respectively and the two wedge-shaped teeth are located on opposite sides of the filling pipeline; and/or, a wedge-shaped groove is provided on a position, opposite the wedge-shaped tooth, of the outer side wall of the filling pipeline, a side wall, close to the spring, of the wedge-shaped groove is vertically arranged, and a side wall, close to the locking hydraulic cylinder, of the wedge-shaped groove is a smooth inclined plane and extends to the outer side wall of the filling pipeline.

9. The monitoring device according to claim 1, further comprising a monitoring system, wherein the monitoring system comprises a solar power supply module, monitoring control equipment and a monitoring pier;

the monitoring pier is poured in an open and stable place beside a rock landslide, the monitoring control equipment and the solar power supply module are fixed on the monitoring pier, the monitoring control equipment is electrically connected to a monitor on the bladder through a monitoring cable to obtain monitoring data of the monitor, and sends the monitoring data to a mobile monitoring terminal or a network through general packet radio service (GPRS) to facilitate monitoring by a monitoring worker at any time, and the solar power supply module is electrically connected to the monitor on the bladder through a monitoring cable, is electrically connected to monitoring control equipment, and continuously supplies power during a monitoring process; and/or, a shaping steel ring is fixed on a periphery of the bladder, and the portion to be clamped is fixed on the shaping steel ring.

10. An arrangement method, based on the monitoring device for deformation of a locked patch crack of a rock slope of claim 1, and comprising:

S1, determining, based on previous geological survey work, a position of an adit of a rock landslide to be monitored, and anchoring a ship carrying an arrangement system beside water surface of an entrance of the adit;

S2, connecting a filling pipeline on a bladder-type monitoring probe to a mortar guiding pipe through an automatic locking and unlocking device, driving a clamping assembly to be positioned in a clamping position by utilizing a clamping driving mechanism, so as to clamp a portion to be clamped on the bladder, and lowering an underwater arrangement device to a position opposite the adit by utilizing a traction mechanism;

S3, driving the clamping driving mechanism to move towards the adit by utilizing a push driving mechanism, and pushing the bladder into the adit;

S4, injecting cement mortar into the bladder through the mortar guiding pipe by utilizing a high-pressure injection machine to expand the bladder until an upper surface and a lower surface of the bladder abut against an upper surface and a lower surface of the adit respectively, and making a monitor on the bladder abut against the upper surface and the lower surface of the adit;

S5, unlocking the filling pipeline and the mortar guiding pipe by utilizing the automatic locking and unlocking device, driving the clamping assembly to be in an unlocking position by utilizing the clamping driving mechanism, driving the clamping driving mechanism to retract by utilizing the push driving mechanism, and lifting the underwater arrangement device to water surface by utilizing the traction mechanism; and S6, repeating S2-S5 to arrange a plurality of bladder-type monitoring probes in an array in the adit.

* * * * *